US006945689B2

(12) United States Patent
Armendariz et al.

(10) Patent No.: US 6,945,689 B2
(45) Date of Patent: Sep. 20, 2005

(54) SYSTEM FOR HOLDING PAINT CONTAINER

(75) Inventors: Adam Armendariz, Buena Park, CA (US); David Armendariz, Lakewood, CA (US); John A. Heiser, Rancho Santa Margarita, CA (US); Christopher E. Jones, Del Mar, CA (US)

(73) Assignee: Masterchem Industries, LLC, Imperial, MO (US)

( * ) Notice: Subject to any disclaimer, the term of this patent is extended or adjusted under 35 U.S.C. 154(b) by 147 days.

(21) Appl. No.: 10/419,054

(22) Filed: Apr. 18, 2003

(65) Prior Publication Data

US 2004/0208083 A1 Oct. 21, 2004

(51) Int. Cl.[7] ..... B01F 11/00; B01F 15/00

(52) U.S. Cl. ..... 366/209; 366/605

(58) Field of Search ..... 366/605, 208, 366/209, 210, 211, 212, 213, 215, 216, 217

(56) References Cited

U.S. PATENT DOCUMENTS

| | | | | | |
|---|---|---|---|---|---|
| 303,080 | A | * | 8/1884 | Weissenborn | 366/212 |
| 377,315 | A | * | 1/1888 | Mains | 366/216 |
| 406,321 | A | * | 7/1889 | Wiedersheim | 366/216 |
| 424,438 | A | * | 3/1890 | Stubbs | 366/217 |
| 766,483 | A | | 8/1904 | Wolfe | |
| 1,018,947 | A | * | 2/1912 | Wall | 366/213 |
| 1,365,963 | A | * | 1/1921 | Brown et al. | 366/210 |
| 1,429,652 | A | * | 9/1922 | Small | 366/214 |
| 1,448,446 | A | | 3/1923 | Hulbert | |
| 1,619,526 | A | | 3/1927 | Meeker | |
| 1,688,665 | A | | 10/1928 | Smellie | |
| 1,755,763 | A | | 4/1930 | Barber | |
| 1,947,398 | A | | 2/1934 | Stuhler | 259/91 |
| 2,006,451 | A | | 7/1935 | Glidden | 91/57 |

(Continued)

FOREIGN PATENT DOCUMENTS

| | | |
|---|---|---|
| JP | 59-135126 | 8/1984 |
| JP | 61-167929 | 7/1986 |
| JP | 2-307523 | 12/1990 |
| JP | 8-309173 | 11/1996 |
| JP | 11-226375 | 8/1999 |
| JP | 2002-79166 | 3/2002 |
| JP | 2002-346358 | 12/2002 |
| WO | WO 03/031041 | 4/2003 |

*Primary Examiner*—Tony G. Soohoo
(74) *Attorney, Agent, or Firm*—Foley & Lardner LLP

(57) ABSTRACT

A system for mixing paint and for holding a container of paint having a cover engaging a body is disclosed. The system comprises a rotary mixer comprising a holder configured for receiving the container. The system also comprises a clamp comprising an arm configured to pivot from a first position to a second position and a plate configured for positioning between a first linear position and a second linear position. The plate in the second linear position maintains the engagement of the cover of the container to the body by compression to inhibit leakage of the paint. A method of mixing paint with a rotary mixer is also disclosed.

22 Claims, 9 Drawing Sheets

U.S. PATENT DOCUMENTS 2,022,527 A 11/1935 Schletz ..... 259/56
2,060,932 A 11/1936 Friermood ..... 259/56
2,082,593 A * 6/1937 Pankotan ..... 366/212
2,228,765 A * 1/1941 Jerwan ..... 366/211
2,374,430 A 4/1945 Hexter ..... 249/14
2,494,866 A 1/1950 Fressola ..... 95/99
2,599,852 A 6/1952 McClain
2,671,648 A * 3/1954 Kost ..... 366/209
2,787,402 A 4/1957 Stiner et al. ..... 222/76
2,797,902 A 7/1957 Buegler ..... 259/72
2,848,019 A 8/1958 Corbin et al. ..... 141/100
2,868,519 A 1/1959 Tocci
2,894,309 A 7/1959 Brzowski ..... 24/263
2,915,640 A 12/1959 Grubel et al. ..... 250/108
3,015,415 A 1/1962 Marsh et al. ..... 222/14
3,018,092 A 1/1962 Johnson ..... 259/54
3,066,830 A 12/1962 Heiss et al. ..... 222/135
3,074,597 A 1/1963 Felts ..... 222/43
3,090,604 A * 5/1963 Wheeler ..... 366/213
3,115,905 A 12/1963 Lau ..... 141/76
3,122,272 A 2/1964 Marsh ..... 222/26
3,173,352 A * 3/1965 Lane ..... 366/213
3,176,967 A * 4/1965 Hartley ..... 366/220
3,281,125 A 10/1966 Shoe et al. ..... 259/72
3,284,057 A 11/1966 Duquette ..... 259/88
3,301,534 A 1/1967 Orser ..... 259/75
3,374,584 A * 3/1968 Haught ..... 366/208
3,480,259 A * 11/1969 Schletz ..... 366/211
3,499,068 A 3/1970 Brown ..... 264/68
3,539,156 A * 11/1970 Zipperer ..... 366/110
3,542,344 A 11/1970 Oberhauser ..... 259/75
3,735,962 A 5/1973 Pagano ..... 259/72
3,735,964 A 5/1973 Lorenzen ..... 259/75
3,880,408 A 4/1975 Karjalainen ..... 259/72
3,885,357 A 5/1975 Hoyt
3,998,434 A 12/1976 Gaynor ..... 259/73
4,004,783 A 1/1977 Wilson ..... 259/72
4,090,612 A * 5/1978 Lostutter ..... 366/214
4,114,196 A 9/1978 Lostutter ..... 366/348
4,118,801 A 10/1978 Kraft et al. ..... 366/111
4,198,166 A 4/1980 Tuns ..... 366/112
4,235,553 A 11/1980 Gall ..... 366/208
4,265,548 A 5/1981 Hall ..... 366/208
4,281,936 A 8/1981 Schotter et al. ..... 366/209
4,329,068 A 5/1982 Neuner et al. ..... 366/214
4,335,759 A 6/1982 Pattiniemi et al. ..... 141/5
4,398,829 A 8/1983 Shick ..... 366/110
4,445,782 A 5/1984 Sparrow, Jr. ..... 366/217
4,468,129 A * 8/1984 McIntosh et al. ..... 366/213
4,497,581 A 2/1985 Miller ..... 366/208
4,568,194 A 2/1986 Gargioni ..... 366/213
4,588,302 A 5/1986 Pizzi et al. ..... 366/349
4,683,706 A 8/1987 Harper ..... 53/485
4,702,610 A 10/1987 Reynolds, Jr. ..... 366/213
4,705,083 A 11/1987 Rossetti ..... 141/104
4,747,693 A 5/1988 Kahl ..... 366/208
4,784,297 A 11/1988 Katz ..... 222/161
4,788,438 A 11/1988 Evers ..... 250/506.1
4,789,245 A 12/1988 Morbeck ..... 366/217
4,813,785 A 3/1989 Miller ..... 366/251
4,842,415 A * 6/1989 Cane et al. ..... 366/110
4,890,931 A 1/1990 Herold
4,922,688 A 5/1990 Langen et al. ..... 53/525
4,967,938 A 11/1990 Hellenberg ..... 222/144
5,050,996 A 9/1991 Allen ..... 366/211
5,167,448 A 12/1992 Herold et al.
5,197,802 A 3/1993 Miller et al. ..... 366/217
5,215,195 A 6/1993 Williams ..... 206/446
5,261,744 A * 11/1993 Brunn ..... 366/217
5,268,620 A 12/1993 Hellenberg ..... 318/114
5,322,358 A 6/1994 Coho et al.
5,352,037 A 10/1994 Jouvin
5,372,425 A 12/1994 Tannenbaum et al. ..... 366/208
5,383,163 A 1/1995 Brunn ..... 366/217
5,399,013 A 3/1995 Sawyer
5,439,287 A 8/1995 Roepke, Sr. ..... 366/130
5,443,314 A 8/1995 Gatlin ..... 366/215
5,458,416 A 10/1995 Edwards et al. ..... 366/209
5,462,353 A 10/1995 Gatlin ..... 366/209
5,468,068 A 11/1995 Hotchkiss, III ..... 366/348
5,474,211 A 12/1995 Hellenberg ..... 222/1
5,493,840 A 2/1996 Cane ..... 53/50
5,507,574 A 4/1996 Dickey ..... 366/213
5,507,575 A 4/1996 Rossetti ..... 366/217
5,551,779 A 9/1996 Gantner et al.
5,662,416 A 9/1997 Dwigans, II ..... 366/209
5,697,703 A 12/1997 Lucchetti ..... 366/198
5,704,711 A 1/1998 Simmons ..... 366/199
5,711,601 A 1/1998 Thomas et al. ..... 366/209
5,746,510 A 5/1998 Mark et al.
5,749,652 A 5/1998 Brunn et al.
5,788,371 A 8/1998 Neri et al. ..... 366/217
5,833,362 A 11/1998 Shepard ..... 366/111
5,906,433 A 5/1999 Mazzalveri ..... 366/209
6,050,719 A 4/2000 Winkler et al. ..... 366/144
6,193,410 B1 2/2001 Puckett, II ..... 366/348
6,302,575 B1 10/2001 Anderson et al. ..... 366/349
6,508,582 B2 1/2003 Friedman ..... 366/110
6,517,230 B1 2/2003 Afnan et al. ..... 366/142
6,582,117 B2 6/2003 Rogers et al. ..... 366/332
6,612,732 B2 9/2003 Blakeman et al.
6,767,125 B2 7/2004 Midas et al.
6,817,751 B2 11/2004 Huckby et al.
2003/0076738 A1 4/2003 Blakeman et al.
2003/0102339 A1 6/2003 Walsh et al. ..... 222/567
2003/0102340 A1 6/2003 Walsh et al. ..... 222/572
2003/0107949 A1 6/2003 Huckby et al. ..... 366/217
2003/0121941 A1 7/2003 Walsh et al. ..... 222/465.1
2003/0142583 A1 7/2003 Santospago et al.
2003/0214878 A1 11/2003 Huckby
2004/0085855 A1 5/2004 Midas et al.

* cited by examiner

SYSTEM FOR HOLDING PAINT CONTAINER

CROSS-REFERENCE TO RELATED PATENT APPLICATIONS

The following U.S. patent applications are cited by reference and incorporated by reference herein: U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in part of U.S. patent application Ser. No. 10/006,985 titled "PAINT CONTAINER" filed Dec. 5, 2001.

FIELD

The present invention relates generally to the field of a system for holding a paint container and more particularly to a compression adapter for use with an orbital or rotary shaker.

BACKGROUND OF THE INVENTION

Paint shakers are used to mix paint prior to sale of the paint and/or prior to use to ensure a homogenous mixture of the paint components that may have separated. Additionally, paint shakers are used to thoroughly mix a tint or colorant to the paint to add and/or change the color of the paint.

One apparatus used for shaking paint employs a top plate and a bottom plate that is moved toward and compresses the paint container between the plates. The plates then move in unison in an up and down direction to thoroughly mix the paint. When a color additive is added to the container by first removing the lid, the compression of the two plates ensures that the paint container lid or cap remains secured to the container body. In this way, no paint can be spilled from the container as the container is moved up and down. The plates move up and down relative to one another along a vector that is perpendicular to both of the plates. The top plate is moved up sufficient to allow the paint container to be removed. Typically, the container is loaded into the shaker between the top and bottom plates in a direction that is parallel to the two planes defined by the top and bottom plates.

A second type of apparatus is an orbital or rotary shaker that moves the container in an orbital or rotary path to mix the paint. In this type of shaker, the container is not moved up and down but rather in an orbital or rotary path. In the rotary type shaker, the paint container is typically loaded into a bucket or holder that has a top opening and a cavity to receive the paint container. In contrast to the compression mixers discussed above, the bucket or holder holds the container in place. Since the paint container is not shaken in an up down direction, the paint container need not be clamped in the up/down direction. This type of shaker allows for easy insertion and removal of the paint container by simply placing the paint container within the open end of the bucket or holder. If the cap or lid of the paint container is not securely fixed to the body of the paint container, it is possible that paint will leak out of the cap during the rotary motion of the container.

It would be desirable to combine the benefit of the rotary motion of the rotary shaker with the benefit of a compression clamp to ensure that the paint container does not leak during the rotary motion. It would further be desirable to provide a compression clamp that is easy to use by a retail store operator. It would also be desirable to provide a compression clamp that allows for insertion of the paint container into the bucket or holder from above. It would still further be desirable to provide a compression clamp that can be manually applied. It would still further be desirable to provide a system for holding a paint container having one or more of these or other advantageous features.

SUMMARY OF THE INVENTION

The present invention relates to a system for mixing paint and for holding a container of paint having a cover engaging a body. The system comprises a rotary mixer comprising a holder configured for receiving the container. The system also comprises a clamp comprising an arm configured to pivot from a first position to a second position and a plate configured for positioning between a first linear position and a second linear position. The plate in the second linear position maintains the engagement of the cover of the container to the body by compression to inhibit leakage of the paint.

The present invention also relates to a system for mixing paint. The system comprises a rotary mixer having a holder for receiving a container of paint. The system also comprises an adapter comprising an arm configured to pivot from a first position to a second position. The system also comprises a plate configured for positioning between a first position and a second position to compress the paint container and inhibit leaking of paint from the container.

The present invention also relates to a system for mixing paint in a container having a cover secured to a body. The system comprises a holder having a base support. The system also comprises a clamp having a plate configured to apply pressure to the cover of the container, the plate being substantially parallel to the base support in a first position, and being movable to a second position not parallel to the base support in a second position. The system also comprises a motor configured to move the holder in a rotary path.

The present invention also relates to a method of mixing paint with a rotary mixer having a holder comprising a retractable arm and a locking plate. The method comprises pivoting the arm to a retracted position. The method also comprises inserting a container of paint having a lid and a body into the holder. The method also comprises pivoting the arm to an advanced position. The method also comprises compressing the locking plate to secure the lid of the paint container to the body. Compressing the locking plate inhibits paint from leaking from the container during mixing.

DETAILED DESCRIPTION OF THE PREFERRED EMBODIMENTS

Figure 1:
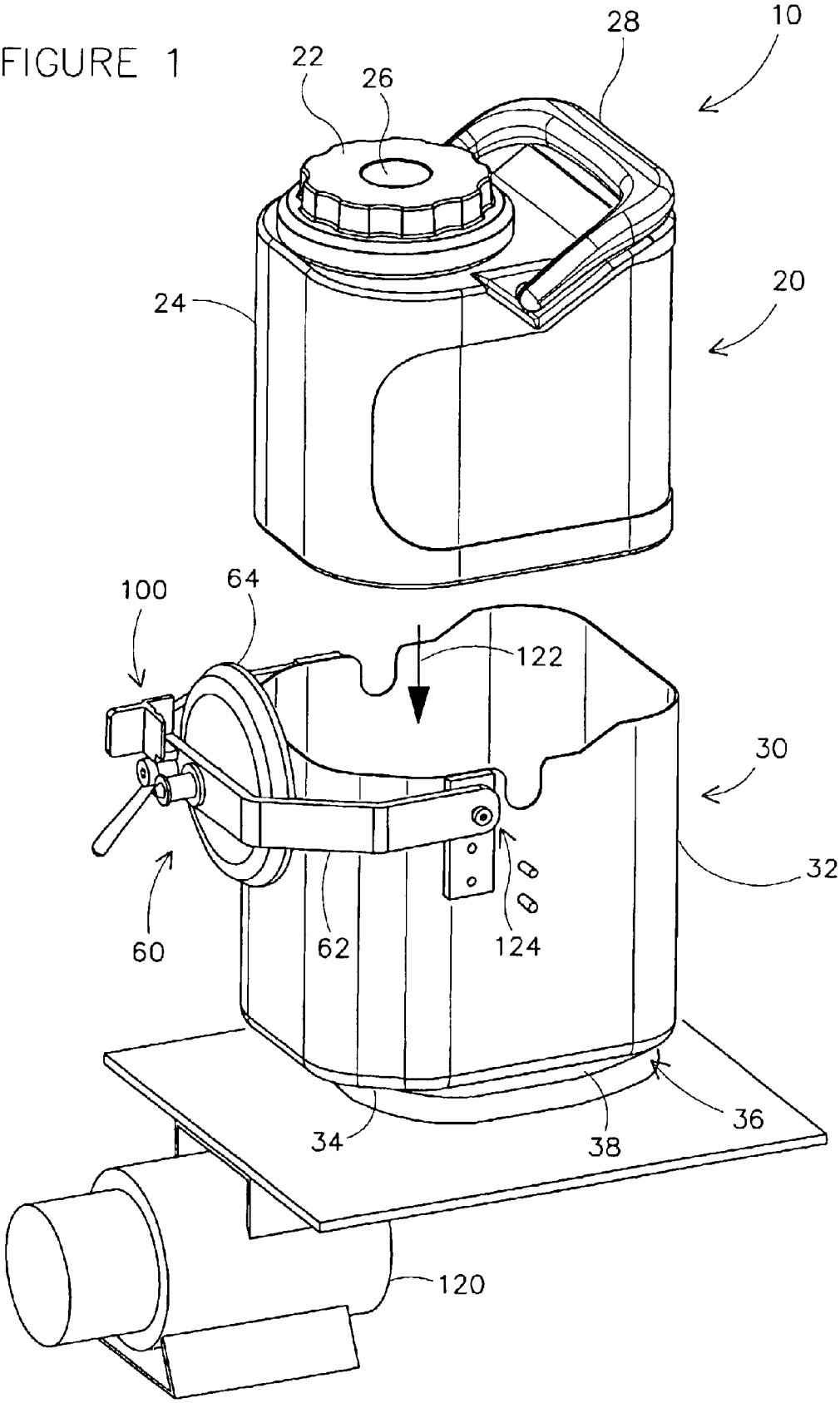
FIG. 1 is an exploded perspective view of a system for holding a paint container according to a preferred embodiment.

A system for holding a paint container is shown as a system 10 in FIG. 1 according to a preferred embodiment. System 10 includes a container 20 for storing a liquid such as paint. System 10 also includes a mixer or shaker 30 having a receptacle bucket or holder 32 for receiving container 20. An adapter or clamp assembly 60 of holder 32 is configured to stabilize and maintain the position of container 20 during shaking and mixing action provided by a motor 120 (shown schematically in FIG. 1).

Motor 120 includes a registration mechanism 36 (shown as a protrusion 38) for registering and aligning the position of holder 32 relative to motor 120. As shown in FIG. 1 according to an exemplary embodiment, protrusion 38 of motor 120 is configured for insertion into a cavity of a base 34 of holder 32. The registration mechanism may also include a mounting interface (such as a pin) according to an alternative embodiment. (According to an alternative embodiment, the holder may be attached to the motor by a fastener such as a clamp, bolt, etc.) According to another alternative embodiment, a registration mechanism of the holder may include a protrusion of the holder for insertion into a cavity of a base of a body 24 of container 20 (see FIG. 1).

The loading and retention of container 20 in holder 32 is shown in FIGS. 2A through 2E according to an exemplary embodiment. Container 20 is "dropped" or loaded into holder 32 from an overhead position along a vector 122 using a bail or handle 28 according to a preferred embodiment (see FIG. 1).

Figure 2A:
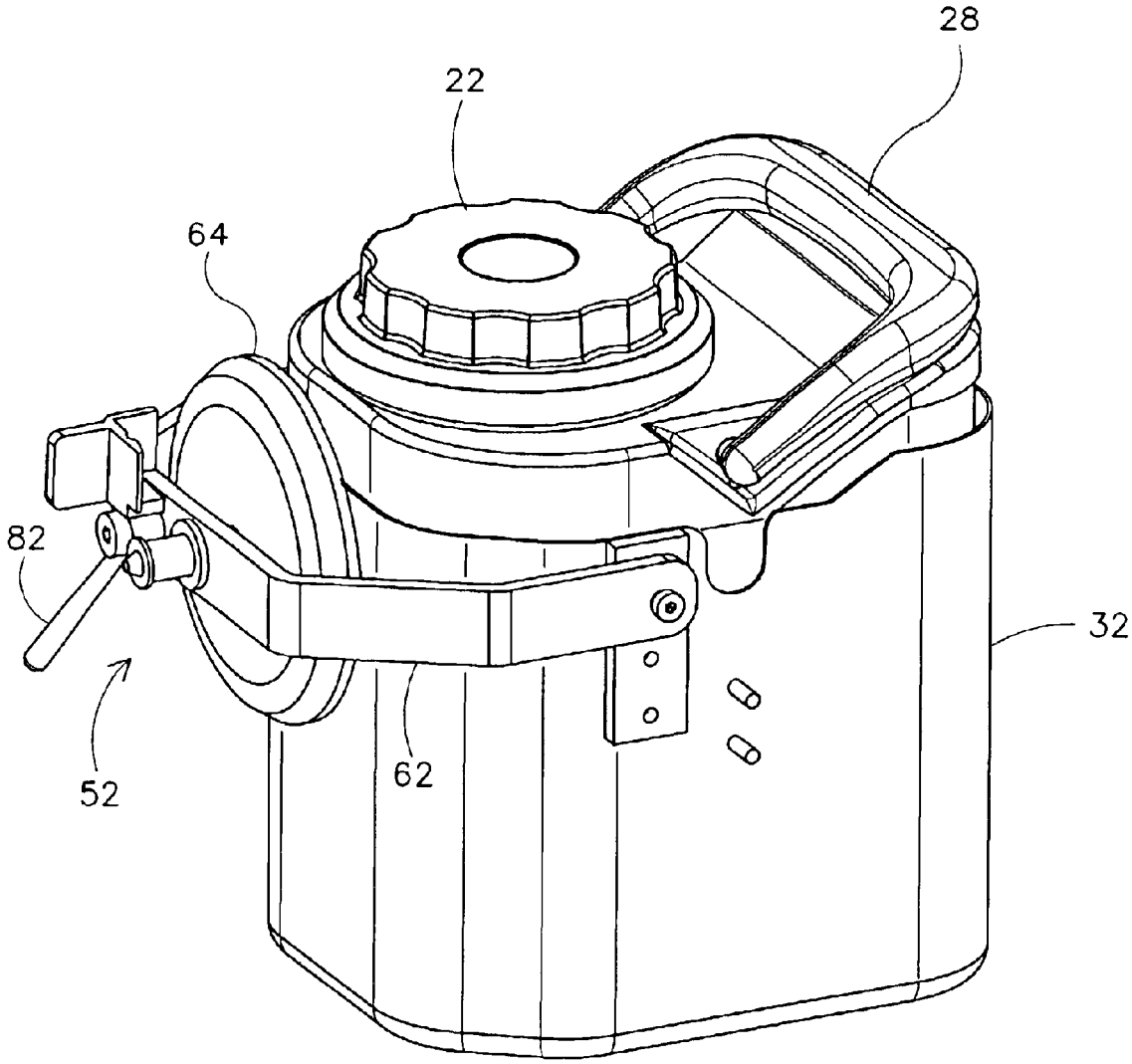
FIGS. 2A through 2E are perspective views of the a system for holding the paint container of FIG. 1 shown locking a paint container according to an exemplary embodiment.
Figure 2B:
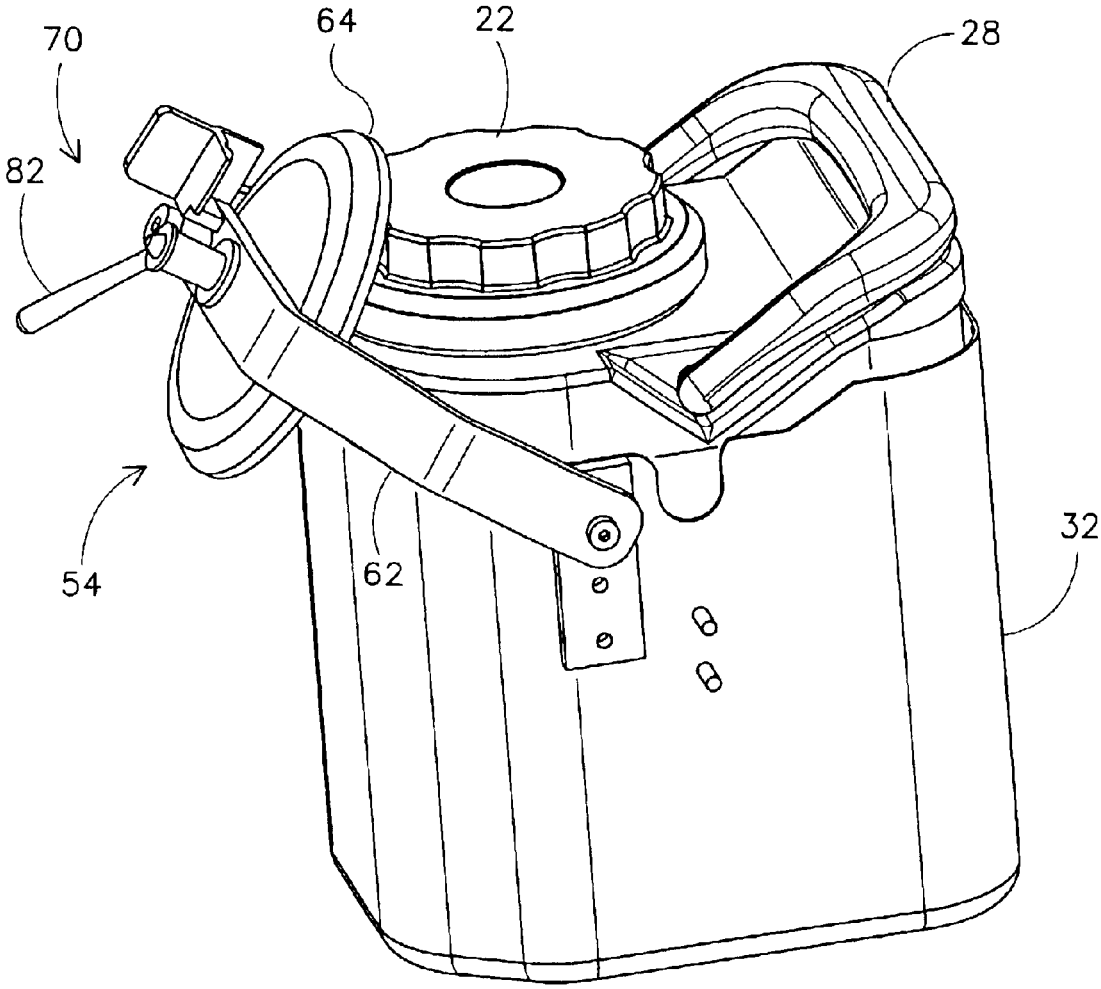
Figure 2C:
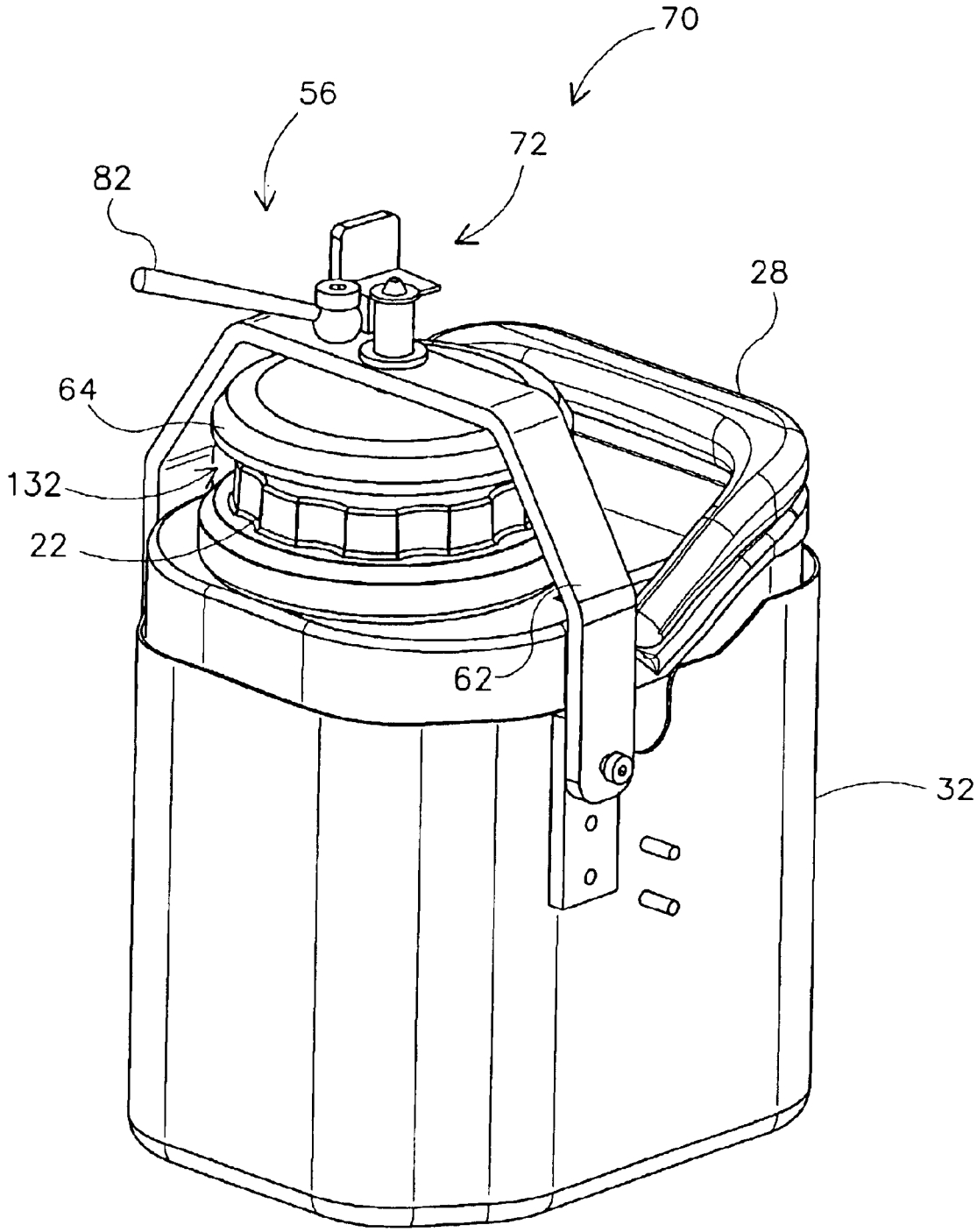

The pivoting of clamp assembly 60 through an opened or retracted position 52 and a closed or advanced "use" position 56 is shown in FIGS. 2A through 2C. A substantially "U"-shaped swing arm 62 of clamp assembly 60 is attached to a side wall of holder 30 by a hinge or pin 124 according to a preferred embodiment as shown in FIG. 1.

Clamp assembly 60 is shown in FIG. 2A in retracted position 52 (e.g. after loading of container 20 in holder 30). A compression jaw or pressure plate 64 is drawn over a cap or lid 22 of container 20 as clamp assembly 60 is moved to a partially retracted position 54 as shown in FIG. 2B. FIG. 2C shows clamp assembly 60 in advanced position 56, a locking mechanism 70 in an uncompressed or unlocked position 72, and plate 64 spaced above lid 22 of container 20. A gap 132 is provided between plate 64 and lid 22 when locking mechanism 70 is in unlocked position 72 as shown in FIG. 2C (see also FIG. 4A).

Figure 2D:
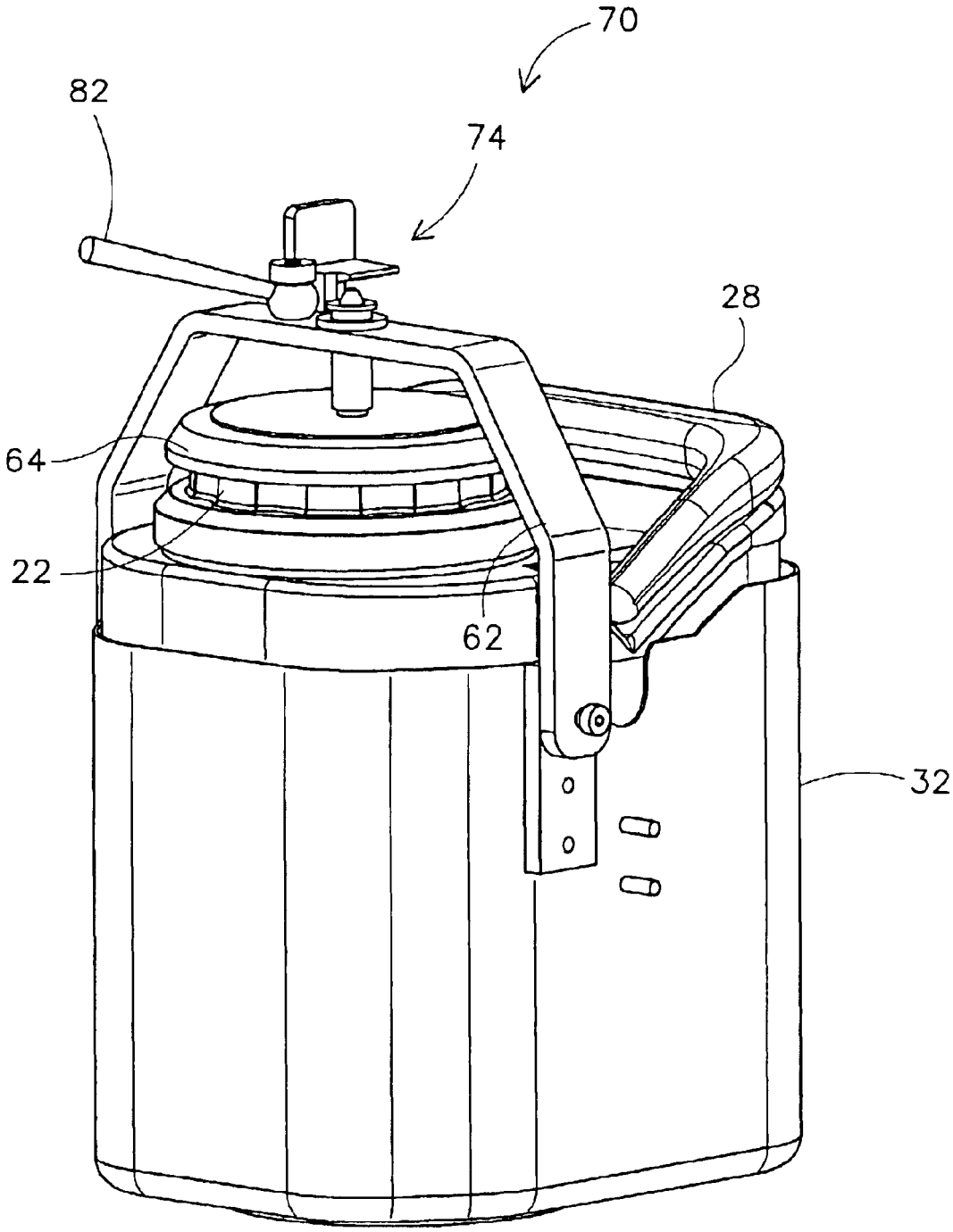
Figure 4A:
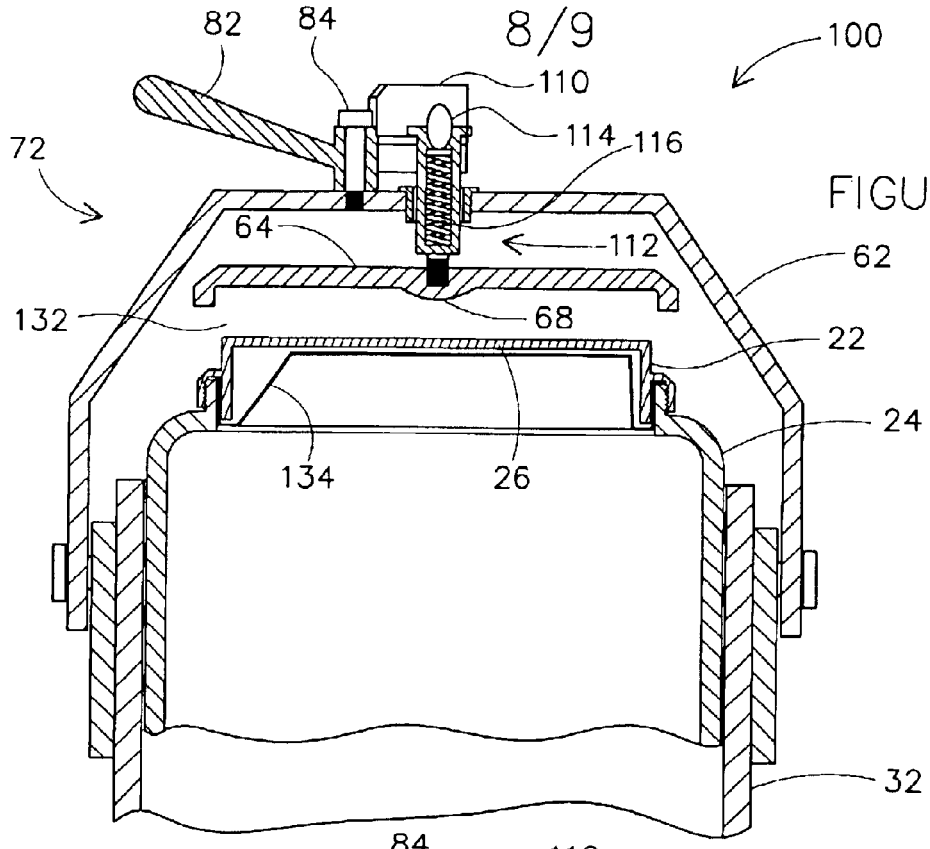
FIG. 4A is a sectional view of the clamp assembly of FIG. 3 showing a clamp in an unlocked position.
Figure 4B:
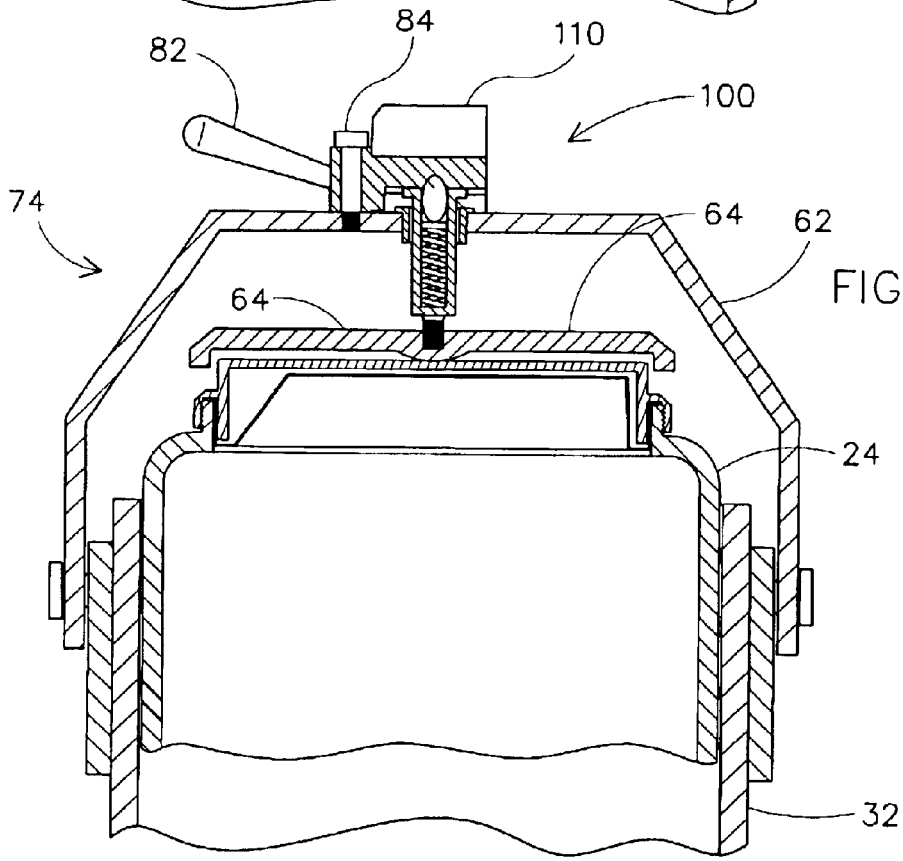
FIG. 4B is a sectional view of the clamp assembly of FIG. 3 showing the clamp in an intermediate position.

Plate 64 is moved from unlocked position 72 to a temporary or intermediate position 74 in which plate 64 "floats" or is driven downwardly to engage lid 22 and substantially eliminate gap 132 as shown in FIG. 2D (see also FIG. 4B). The turning of a handle assembly 80 moves locking mechanism 70 vertically relative to arm 62 from unlocked position 72 (see FIGS. 2D and 4A) to a compressed or locked position 76 (see FIGS. 2E and 4C) according to an exemplary embodiment.

Figure 4C:
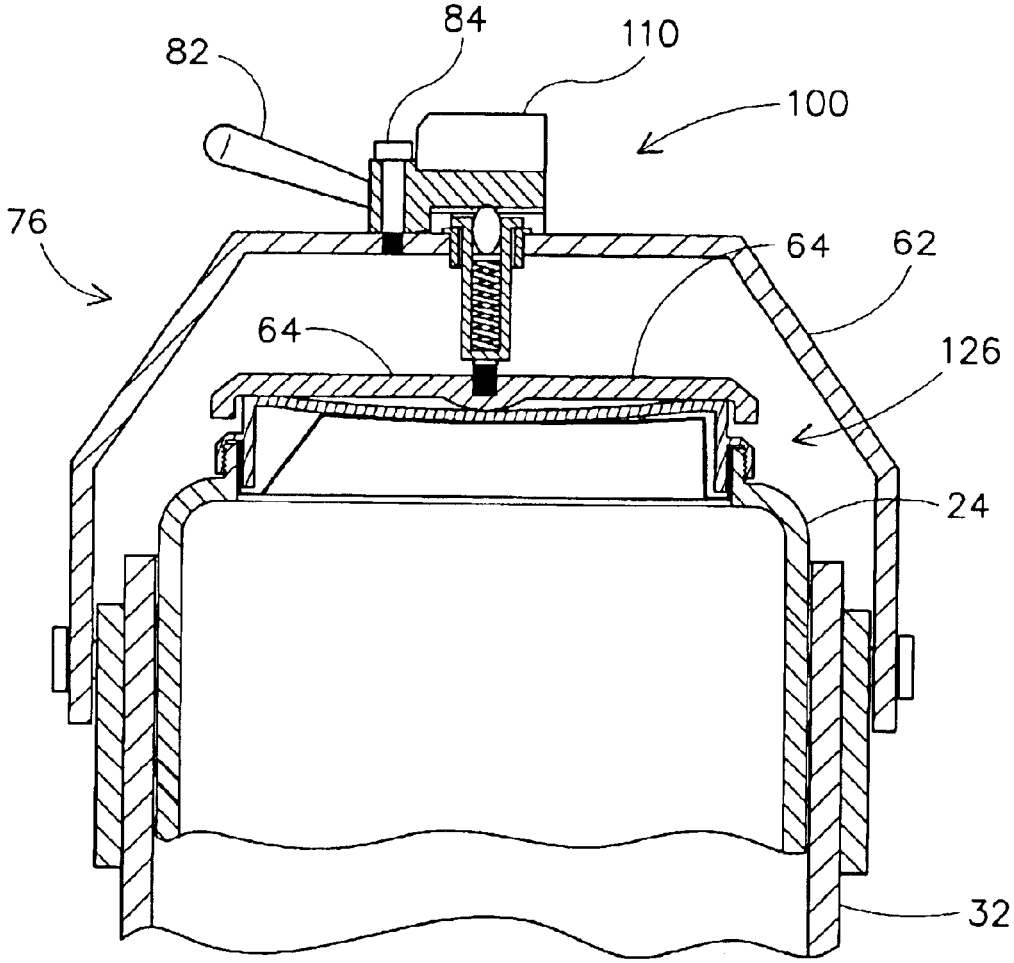
FIG. 4C is a sectional view of the locking mechanism of FIG. 3 showing the clamp in a locked position.

In intermediate position 74, a protrusion or bump 68 of plate 64 makes initial contact with a center 26 of lid 22. In locked position 76, plate 64 applies a downward vertical force to lid 22 (including a peripheral edge 126 of lid 22) to inhibit leakage of the contents of container 20 as shown in FIG. 4C. Bump 68 deflects lid 22 (which may include a convex or concave crown according to alternative embodiments) when clamp assembly 60 is in locked position 76 as shown in FIG. 4C according to a preferred embodiment. According to a preferred embodiment as shown in FIG. 1, center 26 of lid 22 is off-center from the center of base 34 of holder 30 (e.g. situated away from a central vertical axis of the body of the holder).

According to a particularly preferred embodiment, the protrusion has a height of about three-sixteenths of an inch, and a height of about two-sixteenths of an inch according to an alternative embodiment. According to a preferred embodiment, the center of the lid is compressed or deflected downwardly about four-sixteenths of an inch, and the periphery of the lid is compressed or deflected about two-sixteenths of an inch, when the locking mechanism is in the locked position.

According to a particularly preferred embodiment, the plate applies an absolute pressure of about 30 pounds to the lid. According to a preferred embodiment, the protrusion of the plate applies a force of about 0 to 800 psi to the lid when the locking mechanism is in the locked position, preferably less than about 200, more preferably about 60 to 90 psi, more preferably less than about 60 psi. According to an alternative embodiment in which the optional protrusion of the plate is omitted, the plate applies a force of about less than about 5 psi to the periphery of the plate, more preferably less than about 4 psi, more preferably about 2.5 to 4 psi, more preferably about 2.5 to 3 psi. According to an alternative embodiment, the locking mechanism may include a stop action mechanism to limit the compression of the lid and the container, and to limit potential crushing of the lid and the container.

Figure 2E:
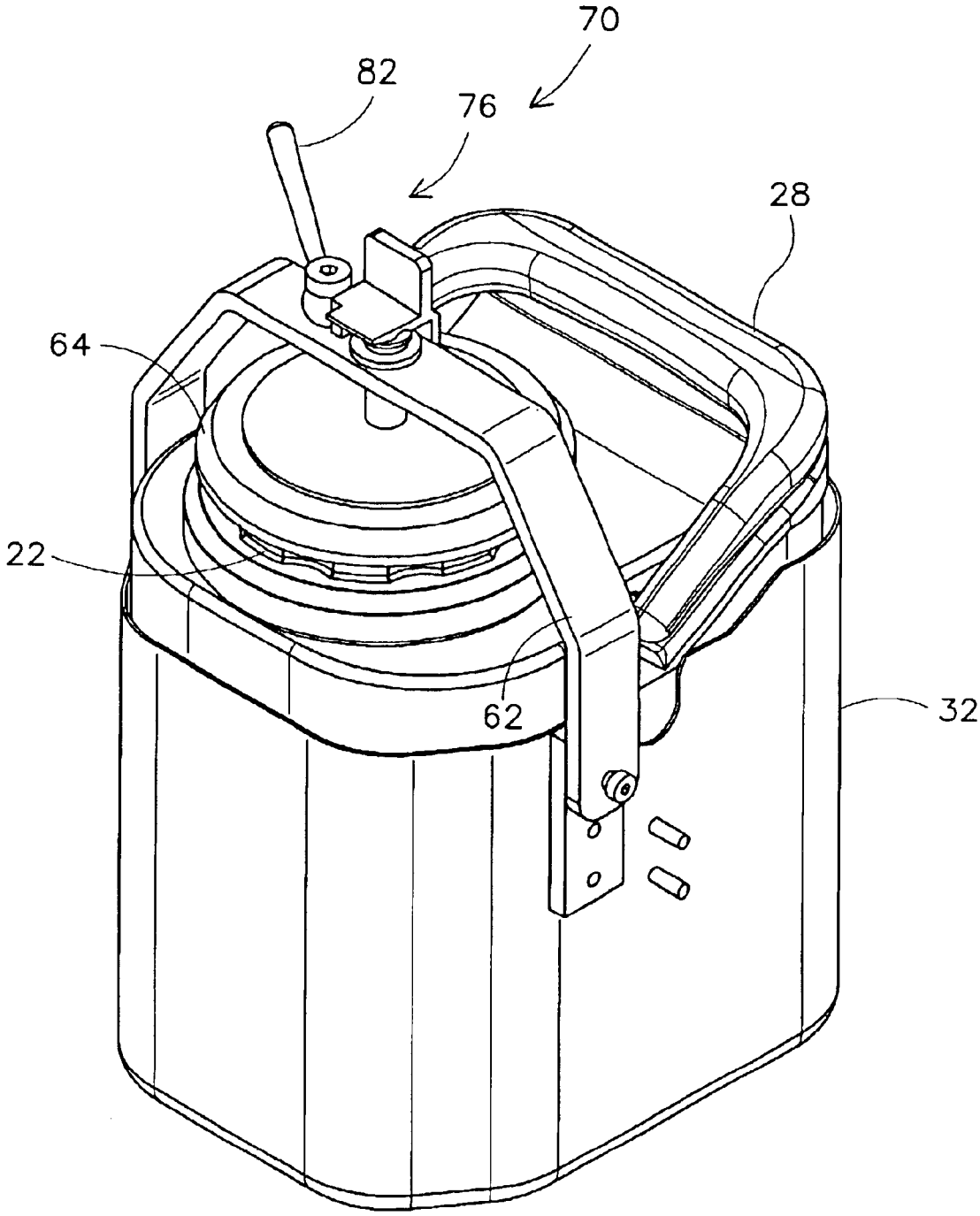

Referring to FIGS. 1 through 2E, container 20 is shown having lid 22 threadably connected to body 24. Container 20 "nests" or fits within holder 32. According to a particularly preferred embodiment, the container has a perimeter that is "D"-shaped, a cross-section that is substantially "D"-shaped, and a substantially flat bottom that is substantially "D"-shaped. The holder has a perimeter that corresponds to the perimeter of the container according to a particularly preferred embodiment (shown as a "D"-shape in FIG. 1 according to a preferred embodiment). According to a particularly preferred embodiment as shown in FIG. 1, container 22 has a volume of about one gallon, and may have other volumes (e.g. one quart) according to other alternative embodiments. According to a particularly preferred embodiment, the lid of the container has an area of about 12.4 square inches. According to a particularly preferred embodiment, the container when filled with paint has a weight of about 8.5 to 12 pounds. The container 20 may include a pour spout 134 according to an alternative embodiment as shown in FIGS. 4A through 4C.

According to a particularly preferred embodiment, the container is of the type disclosed in U.S. patent application Ser. No. 10/255,564 titled "CONTAINER" filed Sep. 25, 2002, which is a continuation-in-part of U.S. patent application Ser. No. 10/132,682 titled "CONTAINER" filed Apr. 25, 2002, which is a continuation-in part of U.S. patent application Ser. No. 10/006,985 titled "PAINT CONTAINER" filed Dec. 5, 2001, which are hereby incorporated by reference.

Figure 3:
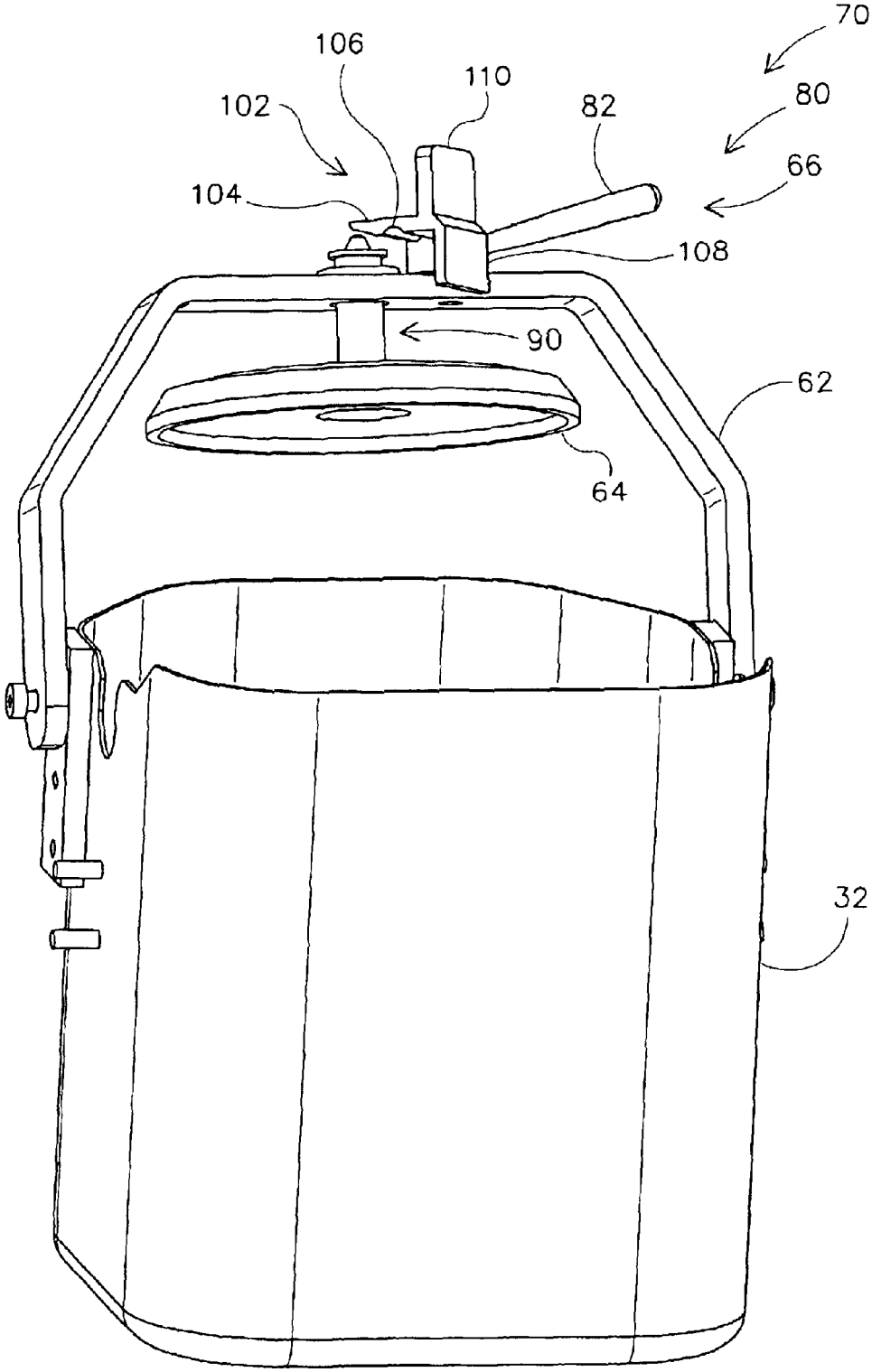
FIG. 3 is a perspective view of a clamp assembly of a paint shaker according to an exemplary embodiment.

Referring to FIG. 3, clamp assembly 60 is shown according to an exemplary embodiment. Clamp assembly 60 acts as a vice to compress lid 22 between plate 64 and base 34 of holder 32. Clamp assembly 60 comprises locking mechanism 70 and a clamping mechanism 66. Clamping mechanism 66 includes plate 64, which moves in a linear direction among unlocked position 72, intermediate position 74 and locked position 76 along vector 122. Plate 64 may be driven or moved (e.g. manually) between unlocked position 72 and intermediate position 74 during loading and unloading of container 20 in holder 32 (see FIG. 2D).

Referring to FIGS. 4A and 4B, locking mechanism 70 includes a handle assembly 80 for pivoting locking mechanism 70 between unlocked position 72 and locked position 76. A follower or handle 82 of handle assembly 80 pivots about a cam or pin 84, which may be "indexed" or notched according to any preferred or alternative embodiment. The turning of handle 82 causes a latching mechanism 100 to turn a latch 102 toward a reciprocating through shaft 90 (see FIGS. 2D and 2E).

Latch 102 includes a ramped or beveled end 104 (see FIG. 3) to engage a plunger 112 having a detent (shown as a ball bearing 114) and a spring 116. When locking mechanism 70 is in locked position 76, a groove 106 of latch 102 engages bearing 114, which maintains the position of latch 102 relative to shaft 90. A locator or stop tab 108 of latch 102 inhibits movement of locking mechanism 70 beyond locked position 76. Latching mechanism 100 also includes a "thumb assist" tab 110 for moving in conjunction with the turning of handle 82.

According to a particularly preferred embodiment, the plunger is a type 316 ball-nose spring plunger having a steel or stainless steel body and a nylon or steel ball, commercially available from McMaster-Carr Supply Company of Chicago, Ill.

It is important to note that the term "paint" is intended to be a broad term and not a term of limitation. Paint, as used in this disclosure, may include, without limitation finishes, surface finishes, varnishes, pigments, colorants, other coatings, etc.

It is important to note that the construction and arrangement of the elements of the system for holding paint container as shown in the preferred and other exemplary embodiments is illustrative only. Although only a few embodiments of the present invention have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, orientations, etc.) without materially departing from the novel teachings and advantages of the subject matter recited in the claims. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present invention as expressed in the appended claims.

What is claimed is:

1. A system for mixing paint and for holding a container of paint having a cover engaging a body comprising:

a rotary mixer comprising a holder configured for receiving the container, the holder having a base and an outer wall extending upwardly from the base, a holder opening is defined by the upper edge of the outer wall, a cavity for receiving the container of paint is defined by the base and the outerwall;

a clamp comprising an arm configured to pivot from a first position to a second position and a plate configured for positioning between a first linear position and a second linear position, the clamp being secured to a swing arm being pivotally attached to the outer wall of the holder at two points, the swing arm extending across the opening when the lid is in the second linear position, the swing arm being movable from below the upper edge of the outer wall to above the upper edge of the outer wall;

wherein the plate in the second linear position maintains the engagement of the cover of the container to the body by compression to inhibit leakage of the paint.

2. The system of claim 1 wherein the first position comprises an opened position and the second position comprises a closed position.

3. The system of claim 1 wherein the first position comprises a retracted position and the second position comprises an advanced position.

4. The system of claim 3 wherein the first linear position comprises an unlocked position and the second linear position comprises a locked position.

5. The system of claim 1 wherein the first position comprises an unloaded position and the second position comprises a loaded position.

6. The system of claim 3 wherein the first linear position comprises an uncompressed position and the second linear position comprises a compressed position.

7. The system of claim 6 wherein in the clamp further comprises a locking mechanism.

8. The system of claim 7 wherein the locking mechanism further comprises a ball and detent.

9. A system for mixing paint comprising a rotary mixer having a holder for receiving a container of paint, the improvement comprising:

an adapter comprising an arm configured to pivot from a first position to a second position and a plate configured for positioning between a first position and a second position to compress the container and inhibit leaking of paint from the container, the plate having a non-planar engagement surface configured to contact an outer periphery and a center region of a cover of the container of paint.

10. The system of claim 9 wherein the first position of the arm is a retracted position.

11. The system of claim 10 wherein the holder is configured to receive the container when the arm is in the retracted position.

12. The system of claim 11 wherein the first position of the plate is an uncompressed position and the second position of the plate is a compressed position.

13. The system of claim 11 wherein the adapter further comprises a locking mechanism.

14. The system of claim 13 wherein the locking mechanism further comprises a handle assembly.

15. The system of claim 14 wherein the locking mechanism further comprises a ball and detent.

16. A system for mixing paint in a container having a cover secured to a body comprising:

a holder having a base support;

a clamp having a plate configured to apply pressure to an outer periphery of the cover of the container, and to apply pressure to a second region on a top portion of the cover, the plate being in direct contact with the outer periphery of the cover and a second region of the cover, the plate having a third region intermediate the outer periphery and the second region that does not apply pressure to a portion of the top portion of the cover, the plate being substantially parallel to the base support in a first position, and being movable to a second position not parallel to the base support in a second position;

a motor configured to move the holder in a rotary path.

17. The system of claim 16 wherein the first position is a use position and the second position is an open position.

18. The system of claim 16 wherein the clamp is configured for pivotal movement between the first position and the second position.

19. The system of claim 16 wherein the holder is configured to receive the container when the clamp is in the second position.

20. A method of mixing paint with a rotary mixer having a holder comprising a retractable arm and a locking plate comprising:

pivoting the arm at two points on an outer wall of the holder to a retracted position, wherein the arm is located below an upper edge of the outer wall of the holder;

inserting a container of paint having a lid and a body into the holder;

pivoting the arm to an advanced position, wherein the arm is located above the upper edge of the outer wall of the holder;

compressing the locking plate to secure the lid of the container to the body;

wherein compressing the locking plate inhibits paint from leaking from the container during mixing.

21. The method of claim 20 wherein compressing the locking plate further comprises positioning the locking plate between an unlocked position and a locked position.

22. The method of claim 20 wherein compressing the locking plate further comprises pivoting a handle between an opened position and a closed position.

* * * * *